US010571098B2

(12) United States Patent
Siltanen

(10) Patent No.: US 10,571,098 B2
(45) Date of Patent: Feb. 25, 2020

(54) LIGHTING ASSEMBLY

(71) Applicant: Teknoware Oy, Lahti (FI)

(72) Inventor: Oskari Siltanen, Lahti (FI)

(73) Assignee: Teknoware Oy, Lahti (FI)

( * ) Notice: Subject to any disclaimer, the term of this patent is extended or adjusted under 35 U.S.C. 154(b) by 0 days.

(21) Appl. No.: 16/251,504

(22) Filed: Jan. 18, 2019

(65) Prior Publication Data

US 2019/0226662 A1 Jul. 25, 2019

(30) Foreign Application Priority Data

Jan. 22, 2018 (FI) ..... 20185054

(51) Int. Cl.
*F21V 21/00* (2006.01)
*F21V 19/00* (2006.01)
(Continued)

(52) U.S. Cl.
CPC ..... *F21V 19/0015* (2013.01); *F21S 4/28* (2016.01); *F21V 3/0625* (2018.02);
(Continued)

(58) Field of Classification Search
CPC .. F21V 19/0015; F21V 17/164; F21V 17/107; F21V 3/0625; F21V 15/013; F21V 4/28; F21V 2115/10; F21V 2103/10
(Continued)

(56) References Cited

U.S. PATENT DOCUMENTS 6,088,967 A * 7/2000 Johnson ..... F21V 3/00 362/145
2011/0261566 A1* 10/2011 Boulton ..... F21V 17/164 362/249.02
2014/0268736 A1* 9/2014 Ratkus ..... F21V 15/013 362/235

FOREIGN PATENT DOCUMENTS

WO WO 2008/134424 A2 11/2008

OTHER PUBLICATIONS

Finnish Search Report for corresponding Finnish Patent Application No. 20185054 dated Aug. 20, 2018, 1 page.
(Continued)

*Primary Examiner* — Ali Alavi
(74) *Attorney, Agent, or Firm* — Merchant & Gould P.C.

(57) ABSTRACT

A lighting assembly, comprising a housing (2) and a lighting element (6). The housing (2) is manufactured by extrusion from at least one flexible material, and comprises a first housing wall (21), a second housing wall (22) and a third housing wall (23). The first housing wall (21) is pivotably connected to the second housing wall (22) by means of a first flexible hinge (31), and the second housing wall (22) is pivotably connected to the third housing wall (23) by means of a second flexible hinge (32). The lighting element (6) is located inside the housing (2), and arranged to emit light out from the housing (2). The housing (2) comprises locking means for releasably locking a free edge of the first housing wall (21) to a free edge of the third housing wall (23) to
(Continued)

arrange the housing (2) in an operating position, the locking means comprising a first locking member (81) formed in the first housing wall (21), and a second locking member (82) formed in the third housing wall (23) and arranged to cooperate with the first locking member (81). The housing (2) is manufactured in one extrusion process, the material of the third housing wall (23) is translucent, and the lighting element (6) is arranged to emit light out from the housing (2) through the third housing wall (23).

15 Claims, 4 Drawing Sheets

(51) Int. Cl.

| | |
|---|---|
| ***F21V 17/16*** | (2006.01) |
| ***F21V 17/10*** | (2006.01) |
| ***F21V 3/06*** | (2018.01) |
| ***F21V 15/01*** | (2006.01) |
| ***F21S 4/28*** | (2016.01) |
| *F21Y 115/10* | (2016.01) |
| *F21Y 103/10* | (2016.01) |

(52) U.S. Cl.
CPC ..... *F21V 15/013* (2013.01); *F21V 17/107* (2013.01); *F21V 17/164* (2013.01); *F21Y 2103/10* (2016.08); *F21Y 2115/10* (2016.08)

(58) Field of Classification Search
USPC ..... 362/249.02
See application file for complete search history.

(56) References Cited

OTHER PUBLICATIONS

Extended European Search Report for corresponding European Patent Application No. 19152315.8 dated Apr. 29, 2019, 10 pages.

* cited by examiner

LIGHTING ASSEMBLY

This application claims benefit of Serial No. 20185054, filed 22 Jan. 2018 in Finland, and which application is incorporated herein by reference. To the extent appropriate, a claim of priority is made to the above disclosed application.

BACKGROUND OF THE INVENTION

The invention relates to a lighting assembly in which a lighting element is located inside an extruded housing.

The known lighting assembly comprises a housing and a translucent dome through which a lighting element of the lighting assembly is arranged to emit light to its surroundings. The problem in this known lighting assembly is that it is complex, which increases the manufacturing costs.

SHORT DESCRIPTION OF THE INVENTION

The object of the invention is to provide a lighting assembly which is structurally simpler than before, and less expensive to manufacture. The object of the invention is achieved by means of a lighting assembly characterized in what is put forth in the independent claim. Preferred embodiments of the invention are presented in the dependent claims.

The invention is based on the idea that the housing of the lighting assembly is manufactured in one extrusion process, so that a translucent housing wall, hinges enabling the housing to be opened and closed, and locking means which are arranged for locking the walls of the housing in their tubular operating position in which the walls of the housing surround the lighting element, are manufactured in the same extrusion process.

Advantages of the lighting assembly according to the invention are simple structure and low manufacturing costs.

SHORT DESCRIPTION OF THE FIGURES

The invention will now be described in detail in the context of preferred embodiments, with reference to the accompanying drawings in which.

DETAILED DESCRIPTION OF THE INVENTION

Figure 1:
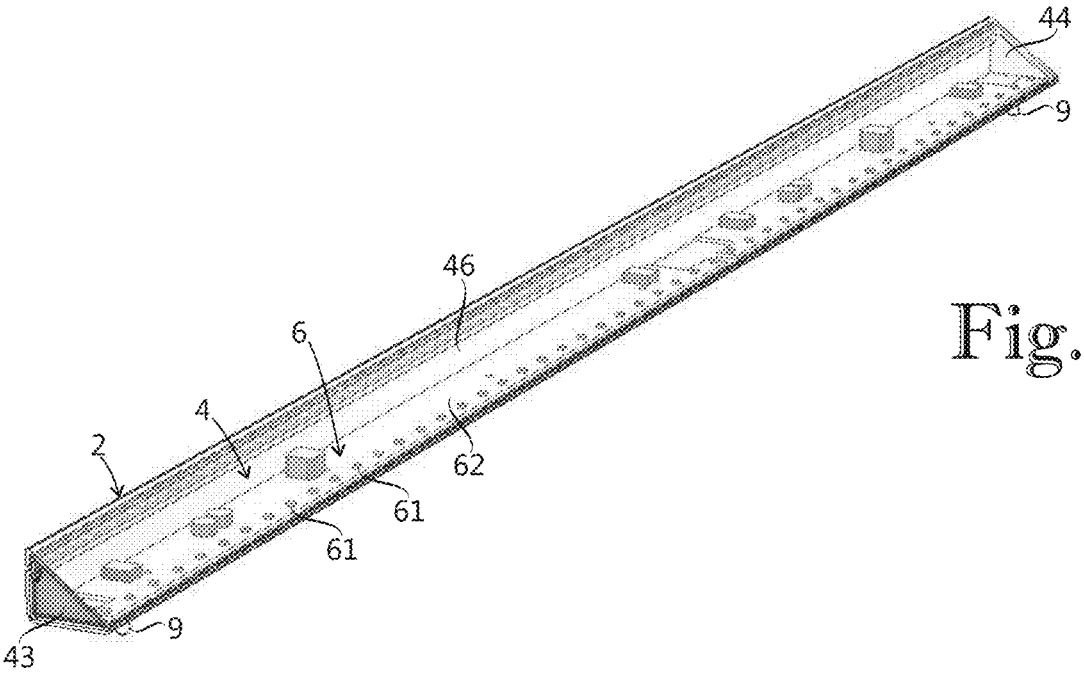
FIG. 1 shows a lighting assembly according to one embodiment of the invention.
Figure 2:
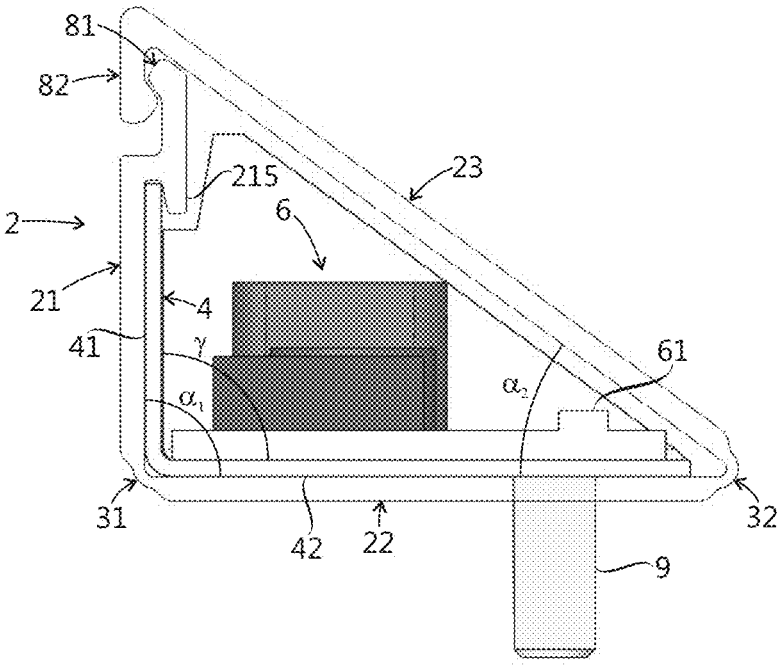
FIG. 2 shows a cross-section of the lighting assembly of FIG. 1.

FIG. 1 shows a lighting assembly which comprises a housing 2, a holder 4 and a lighting element 6. FIG. 2 shows a cross-section of the lighting assembly of FIG. 1. The viewing direction of FIG. 2 is parallel to the longitudinal direction, i.e. the image plane in FIG. 2 is perpendicular to the longitudinal direction.

The housing 2 has been manufactured by extrusion from a flexible material, and comprises a first housing wall 21, a second housing wall 22, a third housing wall 23, a first flexible hinge 31, a second flexible hinge 32 and locking means. The material of the housing 2 is translucent. The first housing wall 21 is pivotably connected to the second housing wall 22 by means of the first flexible hinge 31, and the second housing wall 22 is pivotably connected to the third housing wall 23 by means of the second flexible hinge 32. Both of the first flexible hinge 31 and the second flexible hinge 32 extend in the longitudinal direction.

The material thickness of the first flexible hinge 31 is smaller than the material thickness of the first housing wall 21 and the second housing wall 22. The material thickness of the second flexible hinge 32 is smaller than the material thickness of the second housing wall 22 and the third housing wall 23. The hinge operation of both the first flexible hinge 31 and the second flexible hinge 32 is based solely on flexibility of the material of the housing 2.

The locking means are configured for releasably locking a free edge of the first housing wall 21 to a free edge of the third housing wall 23 to arrange the housing 2 in an operating position. A free edge of a housing wall refers herein to an edge which is not connected to an adjacent housing wall by means of a hinge. The free edge of the first housing wall 21 and the free edge of the third housing wall 23 extend parallel to the longitudinal direction.

The locking means comprise a first locking member 81 formed in the first housing wall 21, and a second locking member 82 formed in the third housing wall 23 and arranged to cooperate with the first locking member 81 for releasable locking of the free edge of the first housing wall 21 to the free edge of the third housing wall 23. The second locking member 82 comprises a locking projection which protrudes from the free edge of the third housing wall 23 at a locking projection angle θ, such that the locking projection is arranged to contact the external surface of the first housing wall 21 in the operating position of the housing 2. The locking projection angle θ indicates the extent to which the direction of the locking projection deviates inwardly from the direction of the third housing wall 23. The locking projection angle θ is approximately equal to the sum of a first operating angle and a second operating angle, i.e. 126°.

The first housing wall 21 defines a first housing wall plane, the second housing wall 22 defines a second housing wall plane, and the third housing wall 23 defines a third housing wall plane. The longitudinal direction is parallel to the first housing wall plane, the second housing wall plane and the third housing wall plane. The first housing wall 21, the second housing wall 22 and the third housing wall 23 are substantially planar walls.

The housing 2 is shown in the operating position in FIGS. 1 and 2. In the operating position the first housing wall 21, the second housing wall 22 and the third housing wall 23 form a tubular structure which is open at ends, but substantially closed in a direction which is perpendicular to the longitudinal direction. The lighting element 6 is located inside said tubular structure.

In the operating position of the housing 2 a first operating angle $\alpha_1$ of substantially 90° is provided between the first housing wall plane and the second housing wall plane. In alternative embodiments, in the operating position of the housing the first operating angle between the first housing wall plane and the second housing wall plane is 85°-95°.

The third housing wall 23 is a continuous housing wall which is arranged to protect the lighting element 6 by preventing the passage of dirt from outside the housing 2 through the third housing wall 23 to contact the lighting element 6. The light from the lighting element 6 is able to propagate through the third housing wall 23 because the third housing wall 23 is made of translucent material.

In the operating position of the housing 2 a second operating angle $\alpha_2$ of 36° is provided between the second housing wall plane and the third housing wall plane. In alternative embodiments, in the operating position of the housing the second operating angle between the second housing wall plane and the third housing wall plane is 25°-60°.

The holder 4 is located inside the housing 2, and comprises a first holder wall 41, a second holder wall 42, a third holder wall 43 and a fourth holder wall 44. From FIG. 2 it is seen that in the operating position of the housing 2 the first holder wall 41 is located alongside the first housing wall 21, and the second holder wall 42 is located alongside the second housing wall 22.

The first holder wall 41 defines a first holder wall plane, and the second holder wall 42 defines a second holder wall plane. The first holder wall plane is arranged at a holder wall angle $\gamma$ relative to the second holder wall plane. The holder wall angle $\gamma$ is substantially 90°. In alternative embodiments the holder wall angle is 85°-95°.

The holder 4 is an element manufactured from one aluminium sheet blank. In one alternative embodiment the holder is manufactured from other metal than aluminium. In another alternative embodiment the holder is manufactured from plastic.

The internal surface of the holder 4 comprises a light reflecting area 46. The light reflecting area 46 is part of the internal surface of the first holder wall 41. The lighting element 6 is arranged to emit light out from the housing 2 so that at least part of the light from the lighting element 6 is reflected out from the housing 2 via the light reflecting area 46 of the holder 4.

The lighting element 6 is located inside the housing 2, is fastened to the holder 4, and is arranged to emit light out from the housing 2 through the third housing wall 23. The lighting element 6 comprises several LEDs 61, and a circuit card 62 on which the several LEDs 61 are installed.

Figure 3:
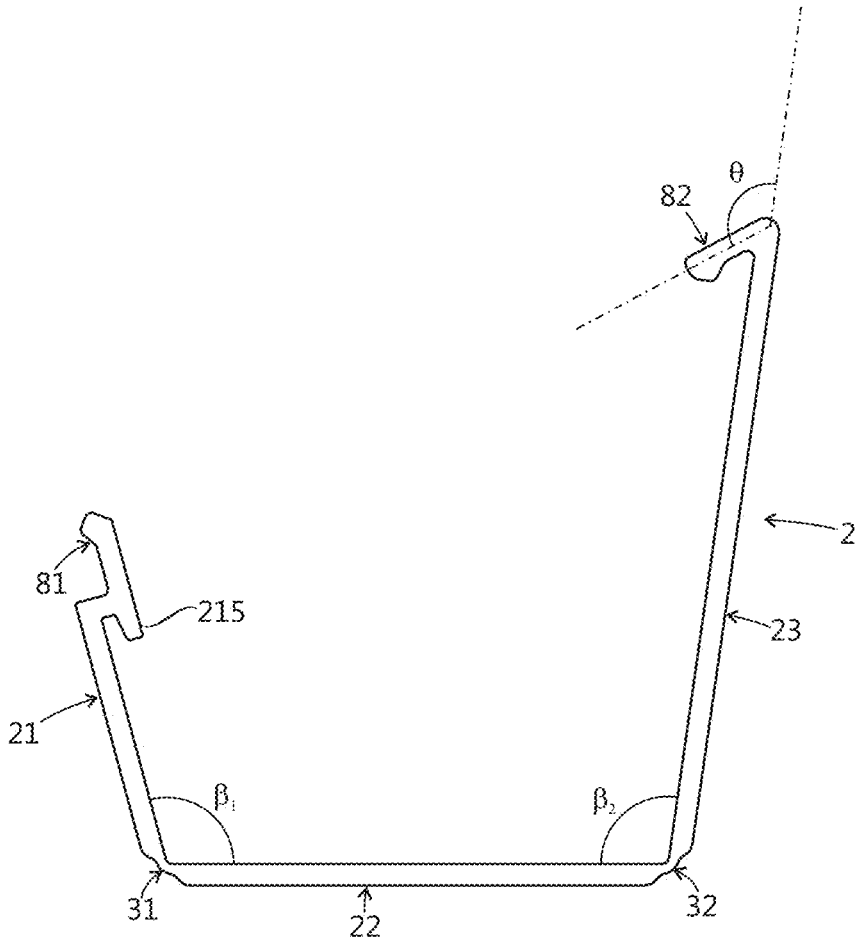
FIG. 3 shows the housing of the lighting assembly of FIG. 1 with housing walls arranged in an installation position relative to each other.

FIG. 3 shows the housing 2 separately from the other lighting assembly components. In FIG. 3 the housing walls of the housing 2 are arranged in an installation position relative to each other, i.e. the first housing wall 21 is in a first installation position relative to the second housing wall 22, and the second housing wall 22 is in a second installation position relative to the third housing wall 23. The first installation position of the first housing wall 21 and the second installation position of the second housing wall 22 are configured for installation of the holder 4 in the housing 2 and for removal of the holder 4 from the housing 2.

In the first installation position a first installation angle $\beta_1$ of 105° is provided between the first housing wall plane and the second housing wall plane. In alternative embodiments the first installation angle is at least 10° larger than the first operating angle. In the second installation position a second installation angle $\beta_2$ of 98° is provided between the second housing wall plane and the third housing wall plane. In alternative embodiments the second installation angle is at least 30° larger than the second operating angle.

The housing 2 is arranged to be such that if the angle between the first housing wall plane and the second housing wall plane is deflected from the first installation angle $\beta_1$, the angle between the first housing wall plane and the second housing wall plane will tend to return to the first installation angle $\beta_1$. Further, the housing 2 is arranged to be such that if the angle between the second housing wall plane and the third housing wall plane is deflected from the second installation angle $\beta_2$, the angle between the second housing wall plane and the third housing wall plane will tend to return to the second installation angle $\beta_2$. The housing 2 tends to return to the position according to FIG. 3, because the housing 2 has been formed by extrusion in that position.

Figure 4:
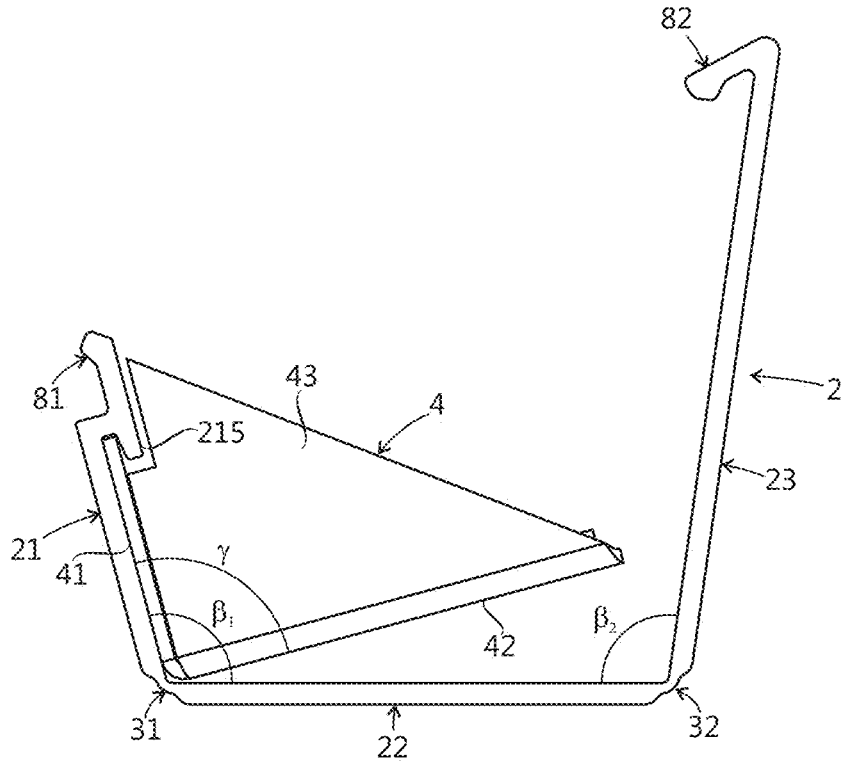
FIG. 4 shows the housing of FIG. 3 with a holder.

FIG. 4 shows the housing 2 in which the housing walls are arranged in the installation position relative to each other, and which is provided with the holder 4. The housing 2 comprises a retainer projection 215 extending from the free edge of the first housing wall 21 so as to form a retaining recess between the first housing wall 21 and the retainer projection 215, the retaining recess arranged to receive a free edge of the first holder wall 41 for keeping the first holder wall 41 in place relative to the housing 2. In FIG. 4 the free edge of the first holder wall 41 has been received in said retaining recess. The retainer projection 215 is arranged to be such that when the housing walls 21, 22 and 23 are arranged in the installation position relative to each other, the holder 4 may be placed inside the housing 2 through the opening between the first housing wall 21 and the third housing wall 23, the installation direction being substantially perpendicular to the longitudinal direction.

In one alternative embodiment the angle between the first housing wall plane and the second housing wall plane does not tend to return to the first installation angle, and the angle between the second housing wall plane and the third housing wall plane does not tend to return to the second installation angle, but the first flexible hinge is arranged to allow the first housing wall to be pivoted relative to the second housing wall to the first installation position, and the second flexible hinge is arranged to allow the second housing wall to be pivoted relative to the third housing wall to the second installation position. Also in this embodiment the first installation position and the second installation position are arranged to facilitate the installation of the holder in the housing and the removal of the holder from the housing.

The third holder wall 43 is located at one end of the housing 2 as seen in the longitudinal direction, and the fourth holder wall 44 is located at the other end of the housing 2 as seen in the longitudinal direction. The third holder wall 43 and the fourth holder wall 44 are arranged to protect the lighting element 6 by preventing the passage of dirt into the housing 2 from its ends. The third holder wall 43 defines a third holder wall plane, and the fourth holder wall 44 defines a fourth holder wall plane. Both of the third holder wall plane and the fourth holder wall plane are substantially perpendicular to the longitudinal direction. In alternative embodiments the third holder wall plane and the fourth holder wall plane are arranged at an angle of over 45° to the longitudinal direction.

The lighting assembly of FIG. 1 comprises two fastening elements 9, each protruding from the second housing wall 22, and being arranged for fastening of the lighting assembly to a wall of an object to be illuminated. The fastening elements 9 are formed in the lighting element 6, i.e. they extend through both of the second holder wall 42 and the second housing wall 22.

Figure 5:
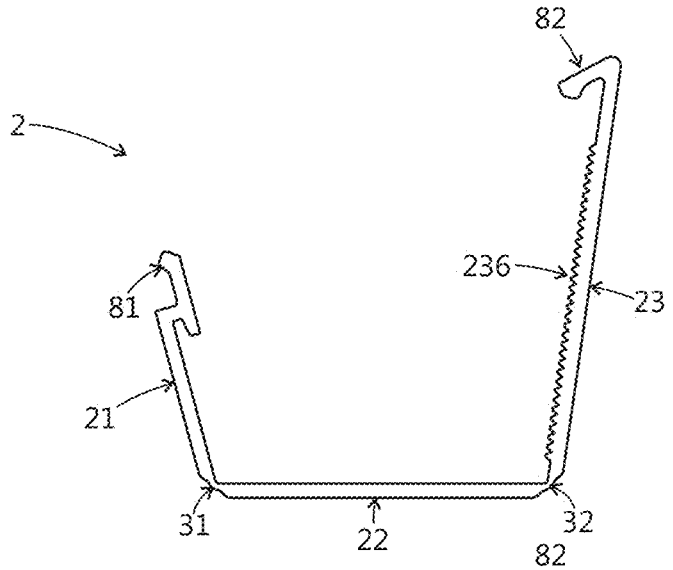
FIG. 5 shows a modification of the housing of FIG. 3 in which a third housing wall comprises optical prisms.
Figure 6:
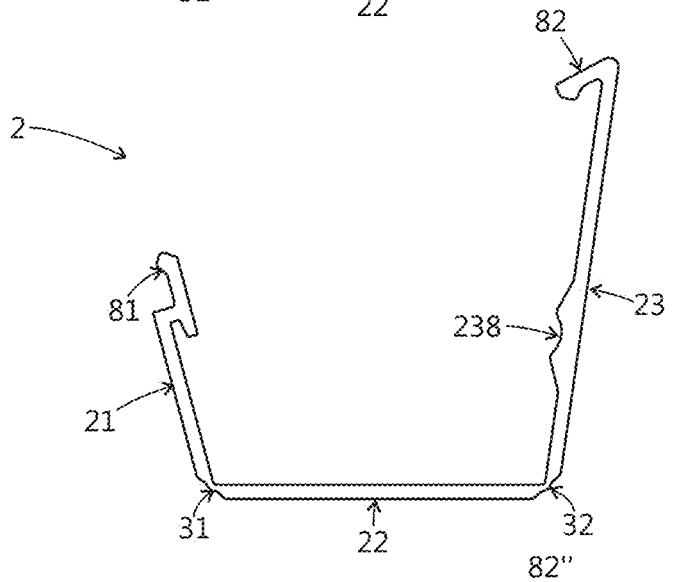
FIG. 6 shows a modification of the housing of FIG. 3 in which a third housing wall comprises a lens.

The third housing wall of the housing may be shaped so as to direct light emitted by the lighting element out from the housing in such a way that the lighting pattern from the lighting assembly will have a desired shape. FIG. 5 shows a modification of the housing of FIG. 3, in which the third housing wall 23 comprises optical prisms 236 which are arranged to direct light emitted by the lighting element out from the housing. FIG. 6 shows a modification of the housing of FIG. 3, in which the third housing wall 23 comprises a lens 238 which is arranged to direct light emitted by the lighting element out from the housing. Both of the optical prisms 236 of FIG. 5 and the lens 238 of FIG. 6 are manufactured from the same material and in the same extrusion process as the third housing wall 23. Apart from the optical prisms 236 and the lens 238, the housings of FIGS. 5 and 6 are similar to the housing 2 of FIG. 3.

Figure 7:
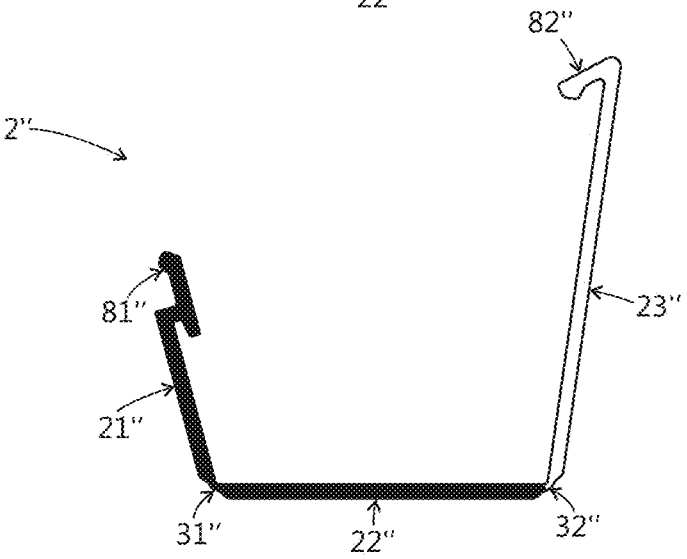
FIG. 7 shows a modification of the housing of FIG. 3 manufactured in a co-extrusion process.

The housing 2 of FIG. 3 is manufactured in one extrusion process from plastic material. All parts of the housing 2 are the same material. In alternative embodiments of the invention the housing is manufactured in a co-extrusion process, such that the housing comprises two or more materials. FIG. 7 shows a modification of the housing of FIG. 3, which has been manufactured from two different materials in one co-extrusion process, such that the material of the third housing wall 23" is translucent, and the material of the first housing wall 21" and the second housing wall 22" is opaque. Both of the materials of the housing 2" are flexible materials. Apart from the materials, the housing 2" of FIG. 7 is similar to the housing 2 of FIG. 3.

Figure 8:
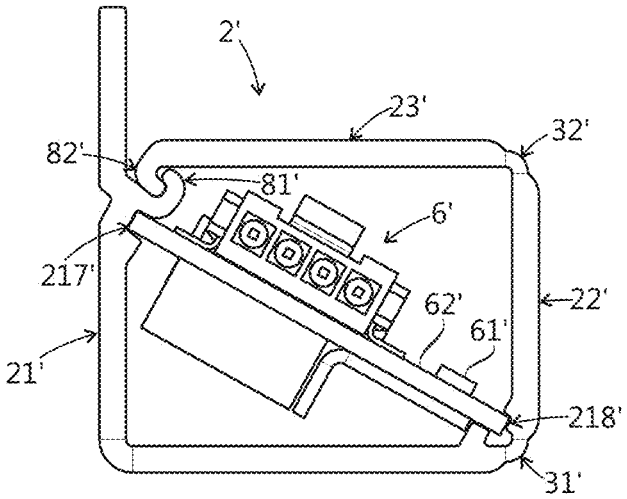
FIG. 8 shows a cross-section of a lighting assembly according to an alternative embodiment of the invention.
Figure 9:
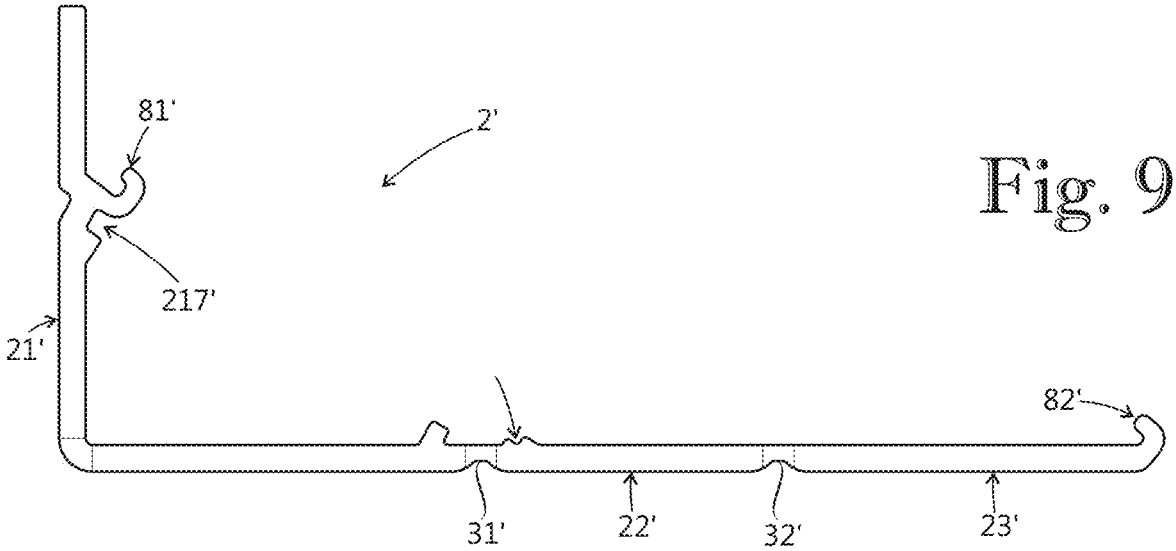
FIG. 9 shows the housing of the lighting assembly of FIG. 8 with housing walls arranged in an installation position relative to each other.

FIG. 8 shows a cross-section of a lighting assembly according to an alternative embodiment of the invention, comprising a housing 2' and a lighting element 6'. The viewing direction of FIG. 8 is parallel to the longitudinal direction. FIG. 9 shows the housing 2' of the lighting assembly of FIG. 8 with housing walls arranged in an installation position relative to each other.

The lighting assembly of FIG. 8 differs from the lighting assembly of FIG. 1 in that the first housing wall 21' is not a substantially planar wall, but has a substantially L-shaped cross-section. Further, the lighting assembly of FIG. 8 does not comprise the holder 4, but the lighting element 6' is directly supported against the internal walls of the housing 2'.

The internal surface of the first housing wall 21' is provided with a first installation recess 217' which is arranged to receive part of the lighting element 6' for keeping the lighting element 6' in place relative to the housing 2'. In addition, a second installation recess 218' is provided at the boundary between the first housing wall 21' and the second housing wall 22' and arranged to receive another part of the lighting element 6' for keeping the lighting element 6' in place relative to the housing 2'. As seen in FIG. 8, a first edge of the circuit card 62' has been received in the first installation recess 217', and a second edge of the circuit card 62' has been received in the second installation recess 218'. The several LEDs 61' of the lighting element 6' are installed on the circuit card 62'.

It is obvious for a person skilled in the art that the basic idea of the invention may be implemented in many different ways. The invention and its embodiments are thus not limited to the above-described examples but may vary within the scope of the claims.

The invention claimed is:

1. A lighting assembly, comprising:

a housing manufactured by extrusion from at least one flexible material and comprising a first housing wall, a second housing wall, a third housing wall, a first flexible hinge and a second flexible hinge, the first housing wall being pivotably connected to the second housing wall by means of the first flexible hinge, and the second housing wall being pivotably connected to the third housing wall by means of the second flexible hinge, and both of the first flexible hinge and the second flexible hinge extending in a longitudinal direction, and a lighting element located inside the housing, and arranged to emit light out from the housing;

wherein the housing comprises locking means for releasably locking a free edge of the first housing wall to a free edge of the third housing wall to arrange the housing in an operating position, the locking means comprising a first locking member formed in the first housing wall, and a second locking member formed in the third housing wall and arranged to cooperate with the first locking member, and the housing is manufactured in one extrusion process, the material of the third housing wall is translucent, and the lighting element is arranged to emit light out from the housing through the third housing wall.

2. The lighting assembly according to claim 1, wherein the lighting assembly comprises a holder located inside the housing, the holder being an element manufactured from one sheet blank and comprising a first holder wall and a second holder wall, the first holder wall defining a first holder wall plane and the second holder wall defining a second holder wall plane, the first holder wall plane arranged at a holder wall angle to the second holder wall plane, and the lighting element is fastened to the holder.

3. The lighting assembly according to claim 2, wherein:

the first housing wall defines a first housing wall plane, and the second housing wall defines a second housing wall plane, in the operating position of the housing a first operating angle of 85°-95° is provided between the first housing wall plane and the second housing wall plane, the first flexible hinge is arranged to allow the first housing wall to be pivoted relative to the second housing wall to a first installation position configured for installation of the holder in the housing and for removal of the holder from the housing, and in the first installation position a first installation angle which is at least 10° larger than the first operating angle is provided between the first housing wall plane and the second housing wall plane.

4. The lighting assembly according to claim 3, wherein the housing is arranged to be such that if the angle between the first housing wall plane and the second housing wall plane is deflected from the first installation angle, the angle between the first housing wall plane and the second housing wall plane will tend to return to the first installation angle.

5. The lighting assembly according to claim 2, wherein the housing comprises a retainer projection extending from the free edge of the first housing wall so as to form a retaining recess between the first housing wall and the retainer projection, the retaining recess arranged to receive a free edge of the first holder wall for keeping the first holder wall in place relative to the housing.

6. The lighting assembly according to claim 3, wherein:

the third housing wall defines a third housing wall plane, in the operating position of the housing a second operating angle is provided between the second housing wall plane and the third housing wall plane, the second flexible hinge is arranged to allow the second housing wall to be pivoted relative to the third housing wall to a second installation position configured for installation of the holder in the housing and for removal of the holder from the housing, and in the second installation position a second installation angle which is at least 30° larger than the second operating angle is provided between the second housing wall plane and the third housing wall plane.

7. The lighting assembly according to claim 6, wherein the housing is arranged to be such that if the angle between the second housing wall plane and the third housing wall plane is deflected from the second installation angle, the angle between the second housing wall plane and the third housing wall plane will tend to return to the second installation angle.

8. The lighting assembly according to claim 2, wherein the holder comprises a third holder wall and a fourth holder wall, each located at a respective end of the housing as seen in the longitudinal direction, and the third holder wall and the fourth holder wall are arranged to protect the lighting element by preventing the passage of dirt into the housing from its ends.

9. The lighting assembly according to claim 8, wherein the third holder wall defines a third holder wall plane, and the fourth holder wall defines a fourth holder wall plane, and both of the third holder wall plane and the fourth holder wall plane are substantially perpendicular to the longitudinal direction.

10. The lighting assembly according to claim 2, wherein the holder is manufactured from a metal sheet, such as an aluminium sheet.

11. The lighting assembly according to claim 2, wherein an internal surface of the holder comprises a light reflecting area, and the lighting element is arranged to emit light out from the housing so that at least part of the light from the lighting element is reflected out from the housing via the light reflecting area of the holder.

12. The lighting assembly according to claim 1, wherein an internal surface of the first housing wall is provided with a first installation recess which is arranged to receive part of the lighting element for keeping the lighting element in place relative to the housing.

13. The lighting assembly according to claim 1, wherein the material thickness of the first flexible hinge is smaller than the material thickness of the first housing wall and the second housing wall, and the material thickness of the second flexible hinge is smaller than the material thickness of the second housing wall and the third housing wall.

14. The lighting assembly according to claim 1, wherein the third housing wall is shaped so as to direct light emitted by the lighting element out from the housing.

15. The lighting assembly according to claim 1, wherein the lighting element comprises at least one LED.

* * * * *